US006305503B1

(12) United States Patent
Suzuki et al.

(10) Patent No.: US 6,305,503 B1
(45) Date of Patent: Oct. 23, 2001

(54) LOAD DETECTOR FOR ELEVATOR CAGE

(75) Inventors: Satoshi Suzuki, Kanagawa-ken; Kosei Kamimura; Kenji Mizutani, both of Tokyo, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/292,679

(22) Filed: Apr. 16, 1999

(30) Foreign Application Priority Data

Apr. 28, 1998 (JP) ..... 10-119495

(51) Int. Cl.[7] ..... B66B 1/34
(52) U.S. Cl. ..... 187/393; 177/147
(58) Field of Search ..... 187/277, 281, 187/391, 393; 73/1.09, 1.13, 1.15, 763, 783, 796, 811; 177/132, 142, 147

(56) References Cited

U.S. PATENT DOCUMENTS 4,566,341 * 1/1986 Kovacs ..... 73/862.65
4,616,321 * 10/1986 Chan ..... 364/422
4,674,605 * 6/1987 McPherson ..... 187/131
4,766,977 * 8/1988 Yamasaki ..... 187/20
4,793,442 * 12/1988 Heckler et al. ..... 187/115
5,004,076 * 4/1991 Chen et al. ..... 187/130
5,124,626 * 6/1992 Thoen ..... 318/610
5,156,239 * 10/1992 Ericson et al. ..... 187/73
5,306,879 * 4/1994 Pearson ..... 187/131
5,435,416 * 7/1995 Siikonen et al. ..... 187/392
5,441,127 8/1995 Ikejima .
5,531,294 * 7/1996 Burton et al. ..... 187/292
5,852,264 * 12/1998 Muller ..... 187/292

* cited by examiner

*Primary Examiner*—Jonathan Salata
(74) *Attorney, Agent, or Firm*—Oblon, Spivak, McClelland, Maier & Neustadt, P.C.

(57) ABSTRACT

A load detector for an elevator having a cage moving up and down in a shaft for transporting passengers and a cable hanging the cage, including a relative position detector configured to detect a relative position of the cage against the shaft; and a calculator configured to calculate a change of the relative position between the position of the cage just after landing at a floor and the position of the cage just before leaving the floor, and a load of the cage on the basis of the change of the relative position caused by an expansion and contraction of the cable.

3 Claims, 15 Drawing Sheets

LOAD DETECTOR FOR ELEVATOR CAGE

CROSS REFERENCE TO RELATED APPLICATION

This application claims benefit of priority to Japanese Patent Application No. JP-0119495 filed Apr. 28, 1998, the entire disclosure of which is incorporated by reference herein.

BACKGROUND OF THE INVENTION

1. Field of the Invention

The present invention relates to a load detector for an elevator cage.

2. Description of the Background

An ordinary traction type elevator is composed as shown in FIG. 1 and FIG. 2.

In FIG. 1, one terminal of a cable 2 is connected to a cage 1 and the other terminal of the cable 2 is connected to a counter weight via a sheave 31 of a hoisting machine 3 and deflector sheave 4. The hoisting machine is composed of the sheave 31 and a motor 32. The sheave 31 is driven by the motor 32, and the cable 2 is driven by the traction between the sheave 31 and the cable 2. Eventually, the cage 1 is moved up and down via the cable 2.

As shown in enlarged FIG. 2, the cage 1 moves up and down along guide rails 7 by means of guide devices 6 attached to the cage 1. The cage 1 is composed of a cage frame 1A including a crosshead 1A*a*, an upright 1A*b* and a plank 1A*c*, and a cab 1B mounted in the cage frame 1A. That is, construction of the cage 1 is in effect "doubled" by providing the cage frame 1A around the cab 1B, and the cab 1B is supported by vibration-proof materials 1C such as a rubber. The vibration-proof materials 1C reduce vibration transfer from the cage frame 1A to the cab 1B and improve passenger comfort during travel of the cage 1.

Further, a deformation detector 1D is installed between the cage frame 1A and the cab 1B. The vibration-proof materials 1C is pressed by the load of the cab 1B, and the amount of the deformation of the vibration-proof materials 1C is detected by the deformation detector 1D. The amount of the deformation is transmitted to a calculator 11 in an elevator control panel via a transmitting cable 8, a connector box 91 attached on a shaft wall 9*a* of a shaft 9, and a transmitter 10. The calculator 11 calculates the load of the cab 1B or the load of passengers on the basis of the amount of the deformation from the deformation detector 1D.

The calculator 11 also calculates a necessary torque to drive the motor 32 so as to move the cage 1 smoothly at the start time, and outputs the torque signal to a drive controller 12. Accordingly, even if the cage 1 is filled with many passengers, the cage 1 does not move down suddenly at the start time when a brake is off. On the other hand, even if the cage 1 has no passengers, the cage 1 does not move up suddenly at the start time. That is, the drive controller 12 applies a necessary torque to the motor 32 before the brake is off so as to move the cage 1 smoothly at the start time.

In the above described traction type elevator, both the cage frame 1A and the cab 1B need a proper strength. It is not easy for the cage 1 to meet both the requirements of the proper strength and the capacity of the cab 1B.

As the efficiency of the hoisting machine 3 improves, the vibration of the cage 1 has been reduced. Therefore, all cages are not required to be constructed in "double" in order to improve comfort of a ride in the cab 1B.

But if the cage 1 has a "single" construction, that is to say, the cab 1B is integrated with the cage frame 1A, the deformation detector 1D can not be installed between the cage frame 1A and the cab 1B. As a result, since a load of the cab 1B can not be detected properly, the elevator has difficulty in controlling the torque applied to the motor 32 at the start time in accordance with change in the load.

SUMMARY OF THE INVENTION

Accordingly, one object of the invention is to provide a load detector for an elevator which can detect the passenger load, even if a cab is integrated with a cage frame.

This and other objects are achieved by providing a new and improved load detector for an elevator having a cage moving up and down in a shaft for transporting passengers, and a cable supporting the cage, including a relative position detector configured to detect a relative position of the cage against the shaft; and a calculator configured to calculate a change of the relative position between the position of the cage just after landing at a floor and the position of the cage just before leaving the floor, and a load of the cage on the basis of the change of the relative position caused by an expansion and contraction of the cable.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 3:
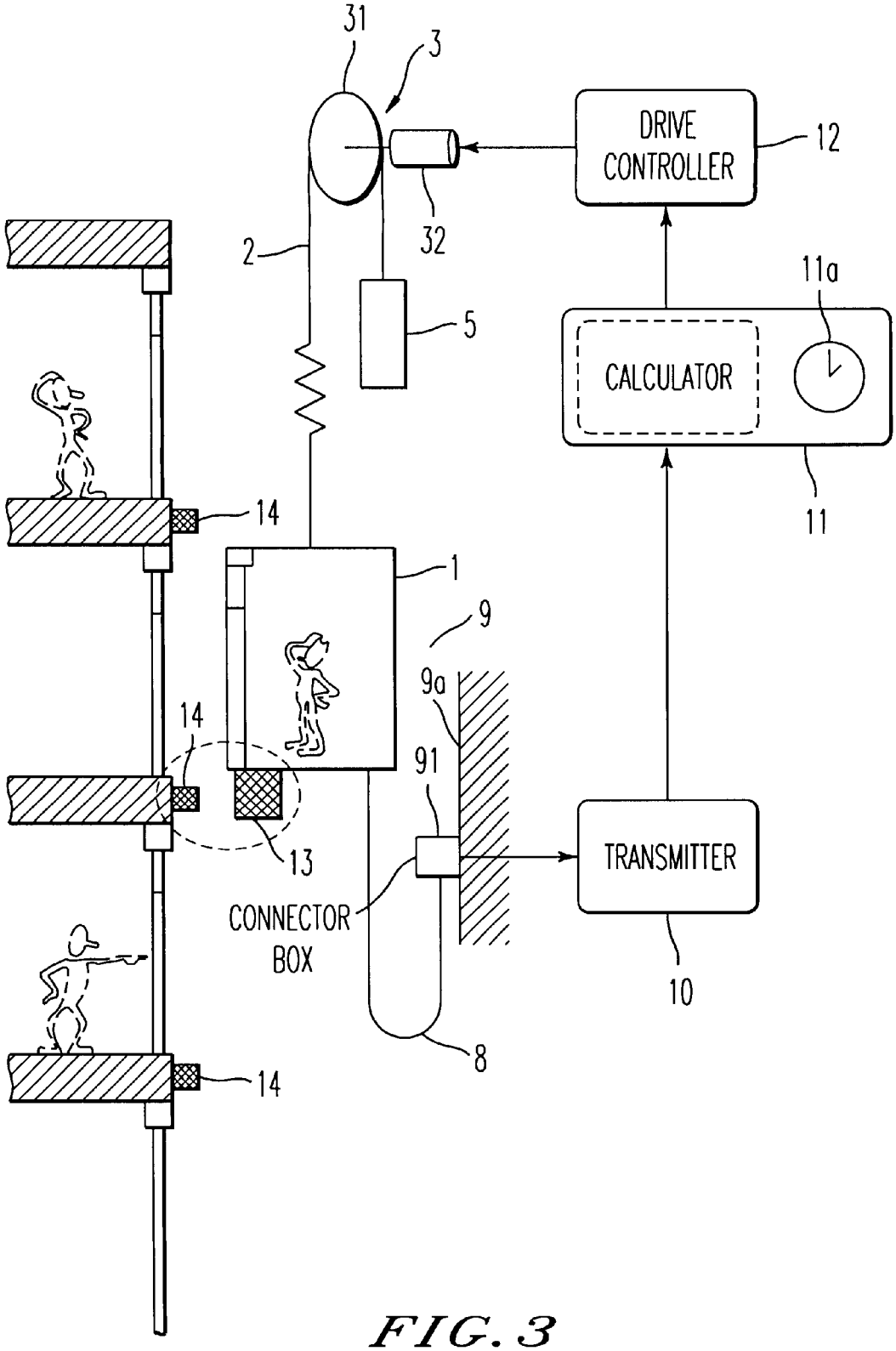
FIG. 3 is a schematic overview of a load detector for an elevator cage of a first embodiment of the present invention.

Referring now to the drawings, wherein like reference numerals designate identical or corresponding parts throughout the several views and more particularly FIG. 3 thereof, FIG. 3 shows a load detector for an elevator cage of a first embodiment of the present invention.

Figure 4:
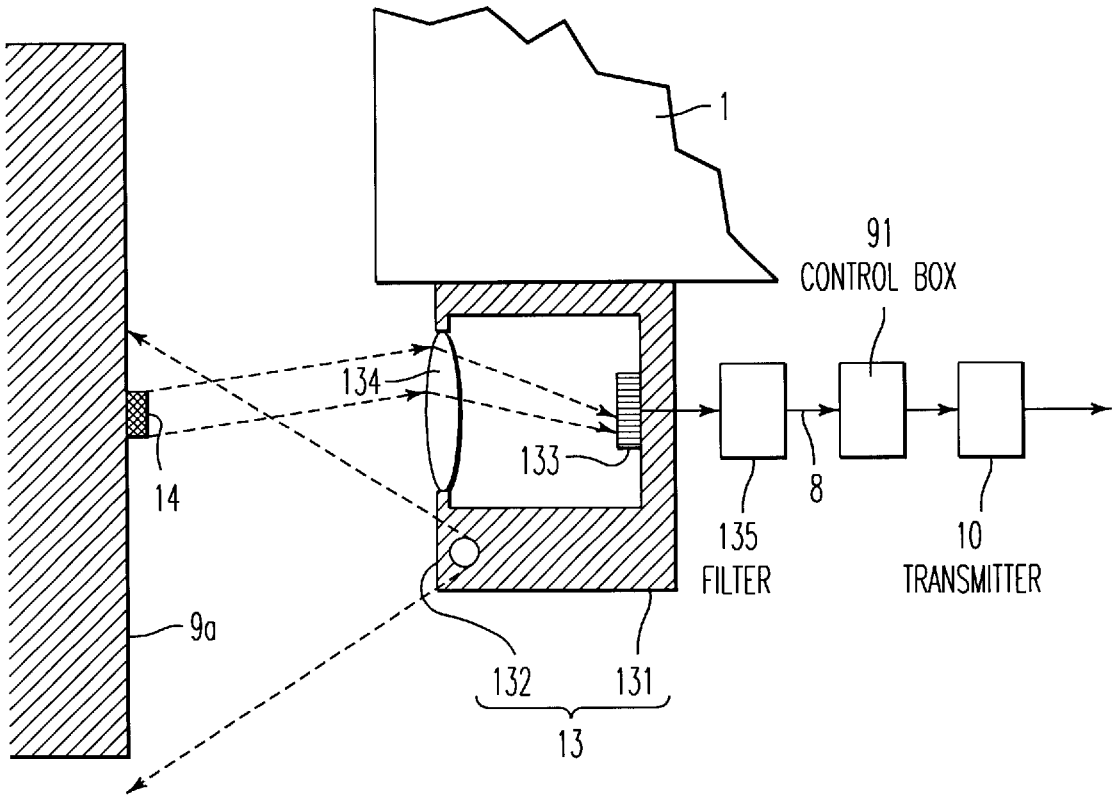
FIG. 4 is a side view of an optical position sensor shown in FIG. 3.

In FIG. 3, a cage 1 for passengers moves up and down by the movement of a cable 2. The cage 1 has a optical position sensor 13. Reflecting plates 14 are attached on a shaft 9 near each floor level and arranged to face the optical position sensor 13 at the time the cage 1 lands at the floor. Thus, a relative position detector is composed of the optical position sensor 13 and the reflecting plate 14. The position sensor 13, as shown in FIG. 4, is composed of a light source 132 in a box 131 for irradiating a light with a predetermined wavelength toward the reflecting plates 14, a lens 134 in the box 131 for gathering a reflected light from one of the reflecting plates 14, and photoconductive cells such as PSD (Position Sensitive Device) elements 133 arranged in the moving direction of the cage. Each of the PSD elements 133 transforms a gathered light from the lens 134 into a voltage signal, and the PSD elements 133 are arranged to output respective different voltage signals in accordance with the position of the cage 1.

If the cage 1 shifts up or down at the landing floor, the voltages produced by the PSD elements 133 of optical position sensor 13 also shift up or down. In other words, a relative position of the cage 1 against the reflecting plate 14 on the shaft 9 changes and the voltage signals from the PSD elements 133 also change on the basis of the relative position of the cage 1 against the reflecting plate 14. The voltage signals are transmitted to a filter 135 in order to extract and output a constituent signal corresponding to the light with the predetermined wavelength. That is, the filter 135 eliminates noise from the voltage signals. The constituent signal is transmitted to a transmitter 10 via a cable 8 and a control box 91 on a shaft wall 9*a*.

A field of vision of the lens 134 is set greater than a field of reflected light from the reflecting plate 14. Reflected light from the shaft wall 9*a* except the reflected light from the reflecting plate 14 is scattered and is not detected by the PSD elements 133 effectively.

When the cage 1 lands on a floor level, the voltage signals from the PSD elements are outputted corresponding to the vertical position of the cage 1 and transmitted to a calculator 11 via the transmitter 10. The calculator 11 has a timer 11*a* and manages the voltage signals in order of the input time. The calculator 11 calculates a passed time after closing a cage door, if there is no call, i.e., either a destination call or a hall call. The destination call is a call by which passengers order the destination in the cage 1, the hall call is a call by which passengers call the cage 1 to a floor. If the passed time exceeds a predetermined time and the cage 1 does not move during the passed time, the calculator 11 resets a load value to zero on the assumption that there is no passenger in the cage 1.

If a destination call is made, the cage 1 goes up or down and lands at the destination floor. The operation of detecting a load of cage 1 is as follows.

First, as the cage 1 approaches to land at a floor level, the optical position sensor 13 detects the reflecting plate 14 of the destination floor. Before the cage door opens, the relative position Yb of the cage 1 against the reflecting plate 14 is detected by the optical position sensor 13. At this time, the cage 1 stops at the landing floor, because the sheave 31 is locked by a brake device (not shown). However, since the cable 2 itself has elasticity, the cable 2 expands and contracts corresponding to a load change of the cage 1. As a result, the vertical position of the cage 1 changes, even if the cage 1 lands and stops on the floor. Consequently, when passengers finish getting on and off, the vertical position of the cage 1 could change corresponding to the load change of the cage 1.

Therefore, after passengers get on and off and the cage door closes, the optical position sensor 13 detects the relative position Ya of the cage 1 against the reflecting plate 14.

The calculator 11 then calculates the current load Mn of the cage 1 on the basis of the relative positions Ya and Yb, an elastic coefficient k of the cable 2, and the previous load Mo of the cage 1, and the current load Mn is calculated as follows.

$$Mn=Mo+k\times(Yb-Ya)$$

The elastic coefficient k can be changed corresponding to the vertical position of the cage 1. Because the length of the cable 2 between the sheave 31 and the cage 1 changes corresponding to the vertical position of the cage 1. Therefore, the elastic coefficient k is applied corresponding to location of the cage 1.

The calculator 11 calculates a necessary torque to drive the motor 32 so as to start the cage 1 smoothly on the basis of the load Mn, and outputs the torque signal to a drive controller 12.

Figure 1:
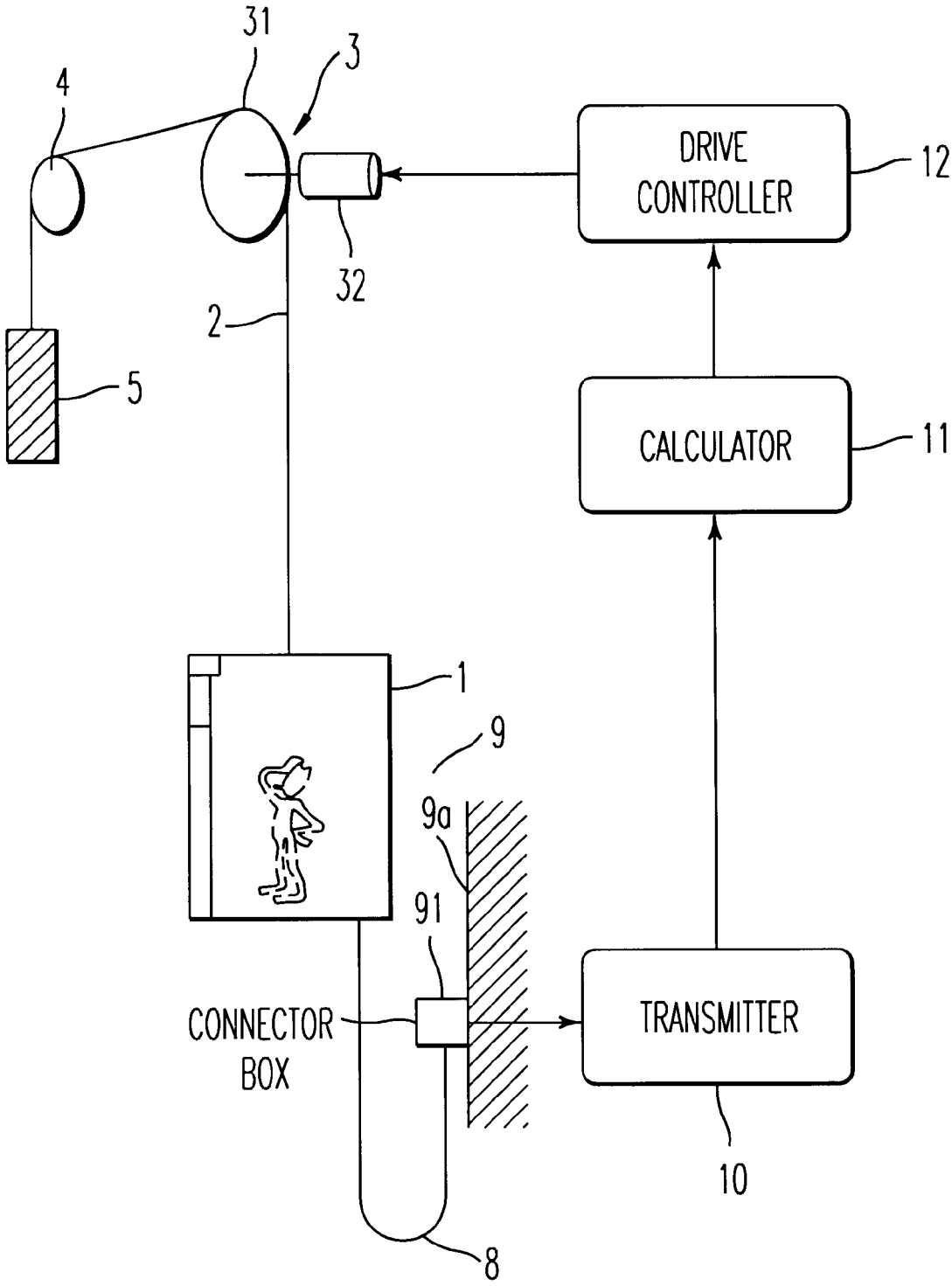
FIG. 1 PRIOR ART
FIG. 1 is a schematic overview of a conventional traction type elevator.
Figure 2:
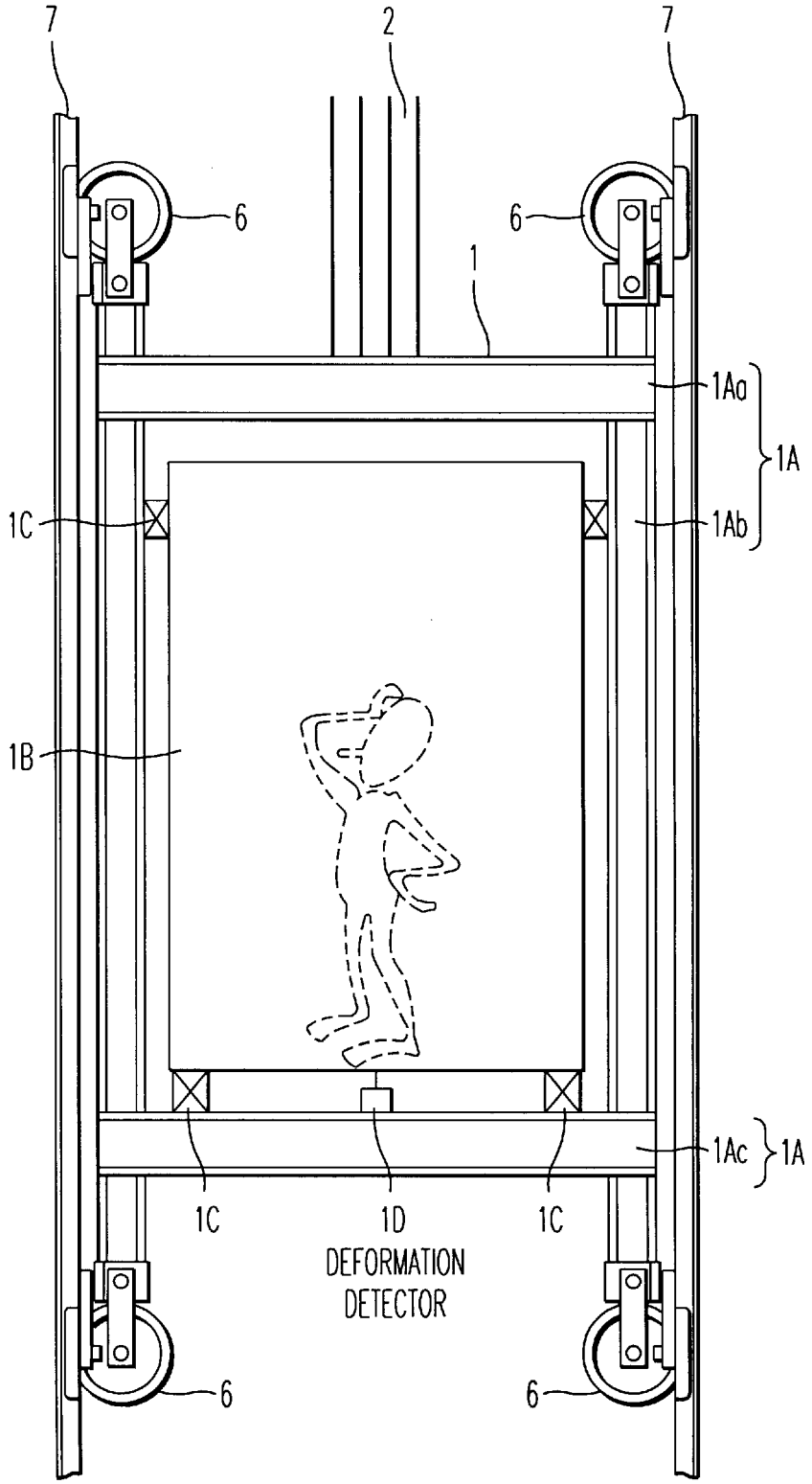
FIG. 2 PRIOR ART
FIG. 2 is a side view of a conventional traction type elevator in FIG. 1.

According to the first embodiment, even if the cage 1 has a "single" construction, that is to say, the cab 1B is integrated with the cage frame 1A in FIG. 1, a load of the cage 1 can be calculated on the basis of the difference of the relative position of the cage 1 against the shaft wall 9*a*, between a vertical position of the cage 1 just after landing at a floor and a vertical position of the cage 1 just before leaving the floor. Further, if the no call time exceeds a predetermined time and the cage 1 does not move for the no call time, the calculator 11 resets the load value to zero indicating that there is no passenger in the cage 1. Therefore, a cumulative error of a load of the cage 1 can be automatically adjusted. Furthermore, since the optical position sensor 13 detects the relative position of the cage 1 against the reflecting plate 14, the load detector can be used as a landing position detector of the cage 1. Moreover, since the optical position sensor 13 detects the relative position of the cage 1 against the reflecting plate 14 without mechanical contact and the filter 135 eliminates noise due to other light sources, the precision of the load detector can be improved.

In the first embodiment, the optical position sensor 13 and the reflecting plate 14 can be changed. A camera having an image sensor which can recognize light and shade can be substituted for the position sensor 13 and a plate having a geometric or other pattern can be substituted for reflecting plate. The camera can then be provided with an image processor (not shown) to recognize an image of the geometric or other pattern, or a portion of this pattern, picked up by the camera, and output different signals corresponding to the position of the cage 1.

Figure 5:
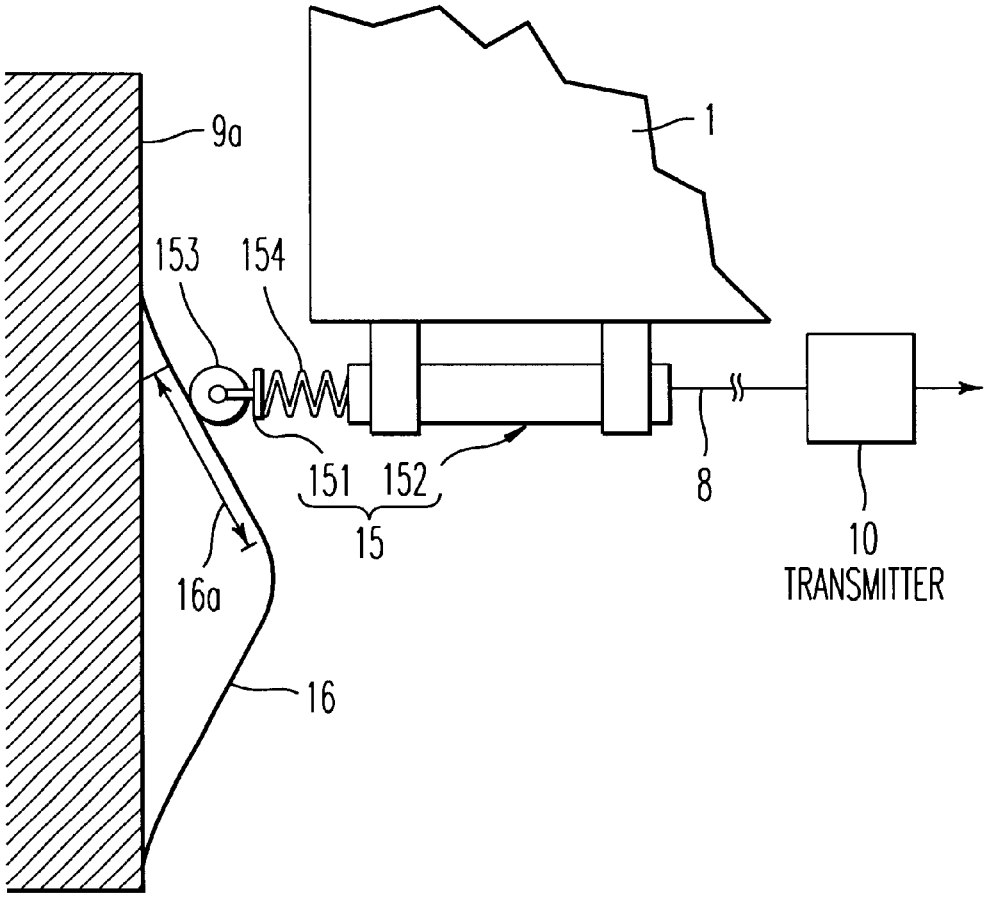
FIG. 5 is a side view of a load detector for an elevator of a second embodiment of the present invention.

FIG. 5 shows a load detector of the second embodiment of the present invention.

In the following description, only components different from the components explained in the related art in FIG. 1 are described.

In this embodiment, a potential meter 15 is attached to the bottom of the cage 1. The potential meter 15 is composed of a slide shaft 151 moving in the axial direction of a cylinder 152. A roller 153 is attached to the end of the slide shaft 151. The roller 153 rotates in the moving direction of the cage 1. A spring 154 is inserted between the roller 153 and the cylinder 152 so that the roller 153 is always forced toward the shaft wall 9*a*.

Slopes 16 are secured on the shaft wall 9*a* near all floor levels. Each slope 16 has an inclined plane 16*a* as shown in FIG. 5. The roller 153 is to pass the floor level contacting the inclined plane 16*a*.

When the cage 1 lands on an exact floor level, that is, a relative position of the cage 1 against a floor level is nearly zero, the roller 153 is to be positioned at the middle of the slope 16.

Accordingly, since the slide shaft 151 is forced toward the shaft wall 9*a* by the spring 154, if the cage 1 moves up and down, the roller 153 rolls on the slope 16, and the slide shaft 151 slides in axial direction of the cylinder 152. As a result, the potential meter 15 outputs voltage signals corresponding to a position of the slide shaft 151, and the voltage signals are transmitted to the transmitter 10 via the transmitting cable 8.

Thus, when the cage 1 stops at the floor, the vertical position change of the cage 1 is read by a horizontal position change of the roller 153.

If a destination call is made, the cage 1 goes up or down and lands at the destination floor. The operation of detecting a load of cage 1 is as follows.

First, as the cage 1 approaches to land at a floor level, the roller 153 contacts the slope 16. Before the cage door opens, the relative position Yb of the cage 1 against the shaft wall 9*a* is detected by the potential meter 15. At this time, the cage 1 stops at the landing floor, because the sheave 31 is locked by a brake device (not shown). However, since the cable 2 itself has elasticity, the cable 2 expands and contracts corresponding to a load change of the cage 1. As a result, the vertical position of the cage 1 changes, even if the cage 1 lands and stops at the floor. Consequently, when passengers finish getting on and off, the vertical position of the cage 1 could change corresponding to a load change of the cage 1.

Therefore, after passengers getting on and off and closing the cage door, the potential meter 15 detects the relative position Ya of the cage 1 against the shaft wall 9*a*.

The calculator 11 then calculates the current load Mn of the cage 1 on the basis of the relative positions Ya and Yb, an elastic coefficient k of the cable 2, and the previous load Mo of the cage 1 in the same way as the first embodiment.

According to the second embodiment, similarly, even if the cage 1 has the "single" construction, that is to say, the cab 1B is integrated with the cage frame 1A in FIG. 1, a load of the cage 1 can be calculated on the basis of the difference of the relative position of the cage 1 against the shaft wall 9*a*, between the vertical position of the cage 1 just after landing a floor and the vertical position of the cage 1 just before leaving the floor.

Figure 6:
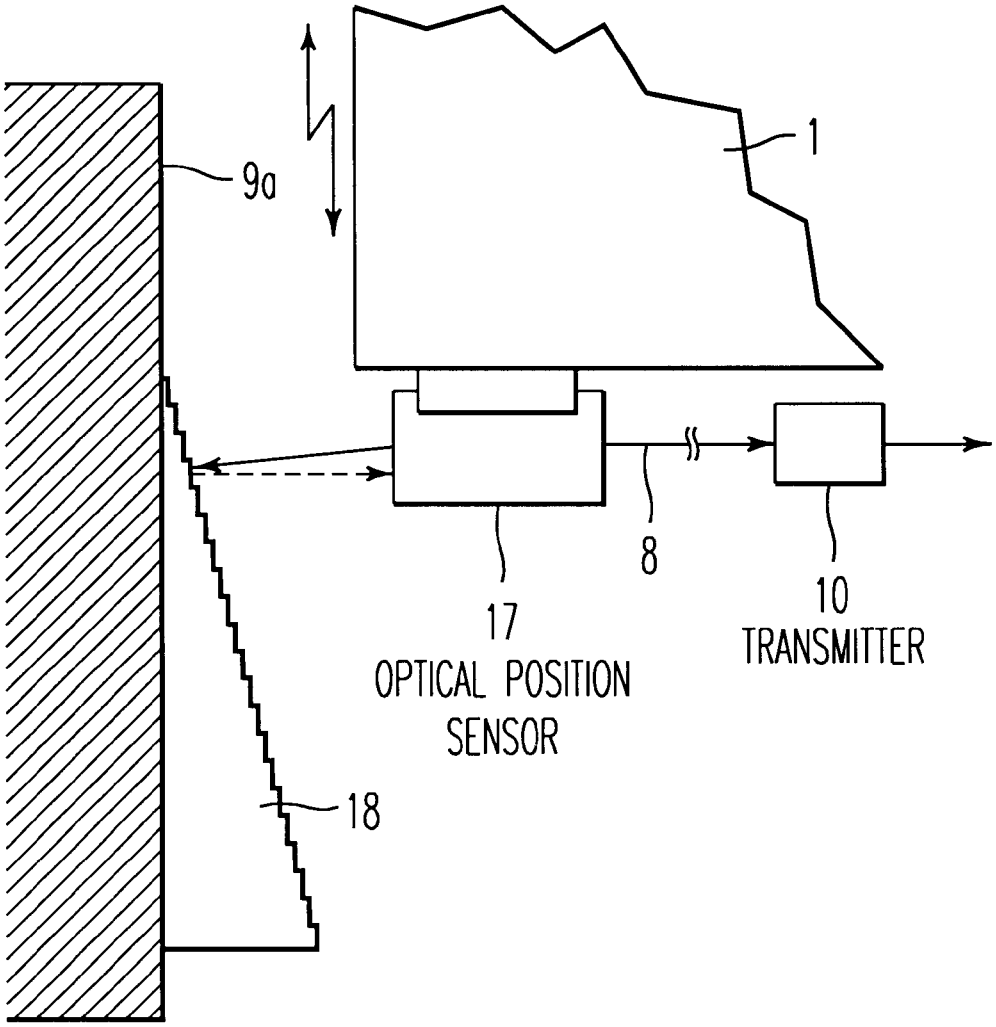
FIG. 6 is a side view of a load detector for an elevator of a third embodiment of the present invention.

FIG. 6 shows a load detector for an elevator cage of a third embodiment of the present invention.

In the following description, only components different from the components explained in the related art in FIG. 1 are described.

In FIG. 6, an optical position sensor 17 is attached to the bottom of the cage 1. Slopes 18 are secured on the shaft wall 9*a* near all floor levels. Each slope 18 has a number of tiers and a triangular cross section as shown in FIG. 6. The horizontal width of each tier is different from another. That is, the horizontal width of the tiers are formed to be gradually changed in the moving direction of the cage 1. The optical position sensor 17 detects a distance from the cage 1 to the tiers of slopes 18. The optical position sensor 17 is composed of a pulse laser device and a distance detector. The pulse laser device irradiates a pulse laser light toward the tiers of slopes 18. The pulse laser light has a relatively narrow beam width, that is, the pulse laser light is not easily scattered. The distance detector detects a reflected laser light from the tiers of the slopes 18 and calculates a distance from the cage 1 to the tiers of the slopes 18.

Accordingly, the optical position sensor 17 outputs voltage signals corresponding to a distance from the cage 1 to the tiers of the slopes 18, and the voltage signals are transmitted to the transmitter 10 via the transmitting cable 8.

Thus, when the cage 1 stops at the floor, the vertical position change of the cage 1 is read by a change of a distance from the cage 1 to the tiers of the slopes 18.

According to the third embodiment, since a vertical position change of the cage 1 is detected by the optical position sensor 17, a load of the cage 1 can be detected in the same way as the second embodiment. Further, since the load of the cage 1 is detected by the optical position sensor 17 with no contact with the slopes 18, error due to frictional wear can be avoided and a durable detector can be obtained.

Figure 7:
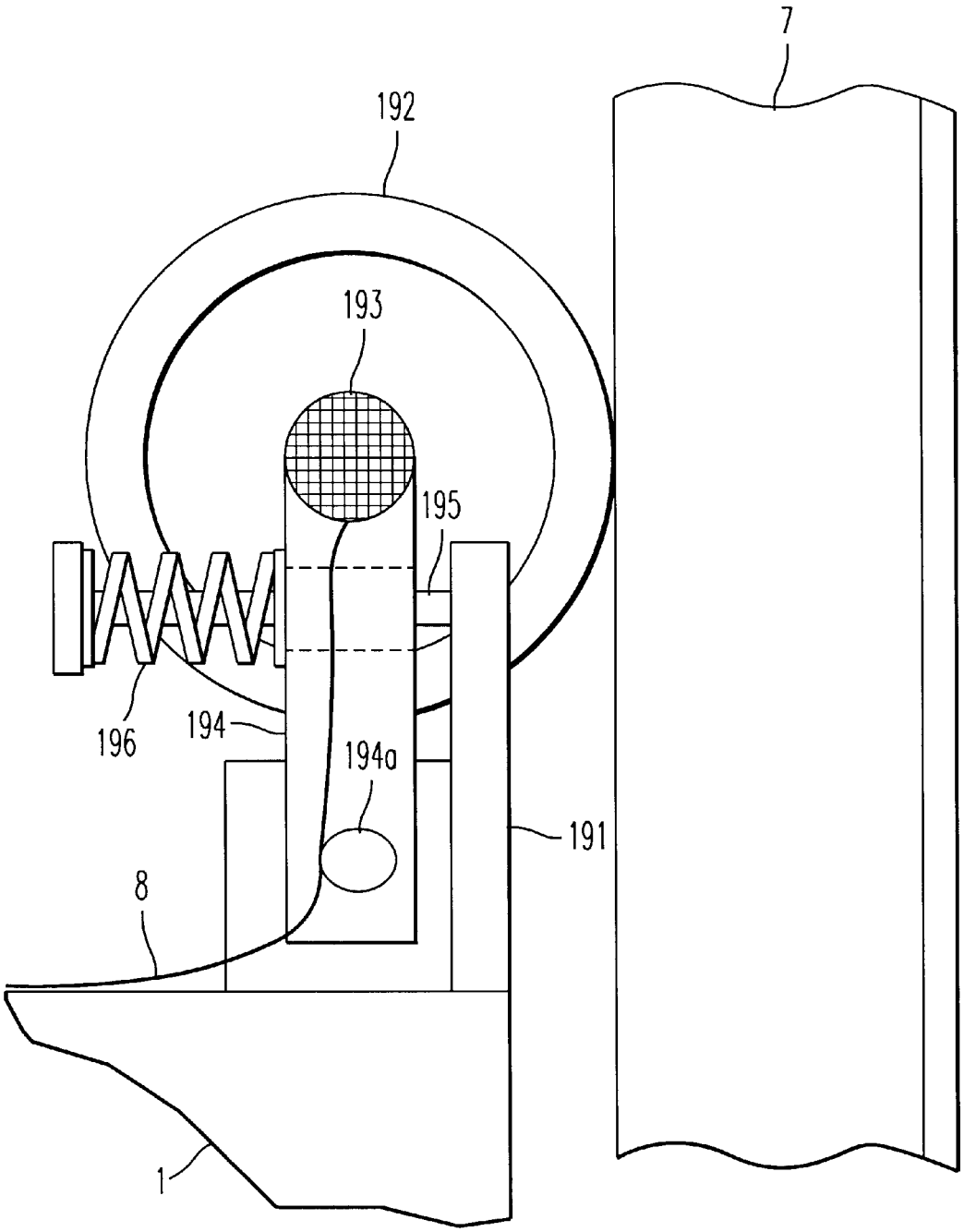
FIG. 7 is a side view of a load detector for an elevator of a fourth embodiment of the present invention.

FIG. 7 shows a load detector for an elevator cage of the fourth embodiment of the present invention, in which the load detector detects a load of the cage by detecting an angle change of a roller rolling on a guide rail in accordance with the movement of the cage 1.

That is, a disk roller 192 is secured to the upper base 191 of the cage 1 and rolls on a guide rail 7 in accordance with the movement of the cage 1. An angle detector 193 is arranged to an axis of the disk roller 192. The angle detector 193 is attached to one end of a lever 194, the other end of the lever 194 is pivotably secured to a fulcrum 194*a* of the base 191. A pole 195 stands on the base and passes through the lever 194. A spring 196 is arranged between one end of the pole 195 and the lever 194 so that the spring 196 pushes the lever 194 toward the guide rail 7 at any time.

Accordingly, the disk roller 192 is pushed with the righting moment of the spring 196 and rolls on the guide rail 7. As the disk roller 192 rotates according to the movement of the cage 1, the angle detector 193 rotates as well. As a result, an angle change of the disk roller 192 is detected by the angle detector 193. Then, the output signal of the angle detector 193 is transmitted to the calculator 11 via the transmitting cable 8 and the transmitter 10.

The calculator 193 calculates a vertical position change of the cage 1 on the basis of the radius of the disk roller 192 and the angle change of the disk roller 192.

Thus, when the cage 1 stops at the floor, a vertical position change of the cage 1 from the time the cage door is opened until the time of closing is read by an angle change of the disk roller 192.

According to the fourth embodiment, a load of the cage 1 can be detected in the same way as the second embodiment. Further, since the calculator 193 is provided with an angular information from the angle detector 193 in accordance with a speed of the cage 1, the calculator 193 can calculate a speed of the cage 1 on the basis of time-differentiating the angular information. If a speed of the motor 32 is controlled by comparing the speed of the cage 1 with the predetermined velocity pattern, the hoisting machine 3 can be extremely precise.

Figure 8:
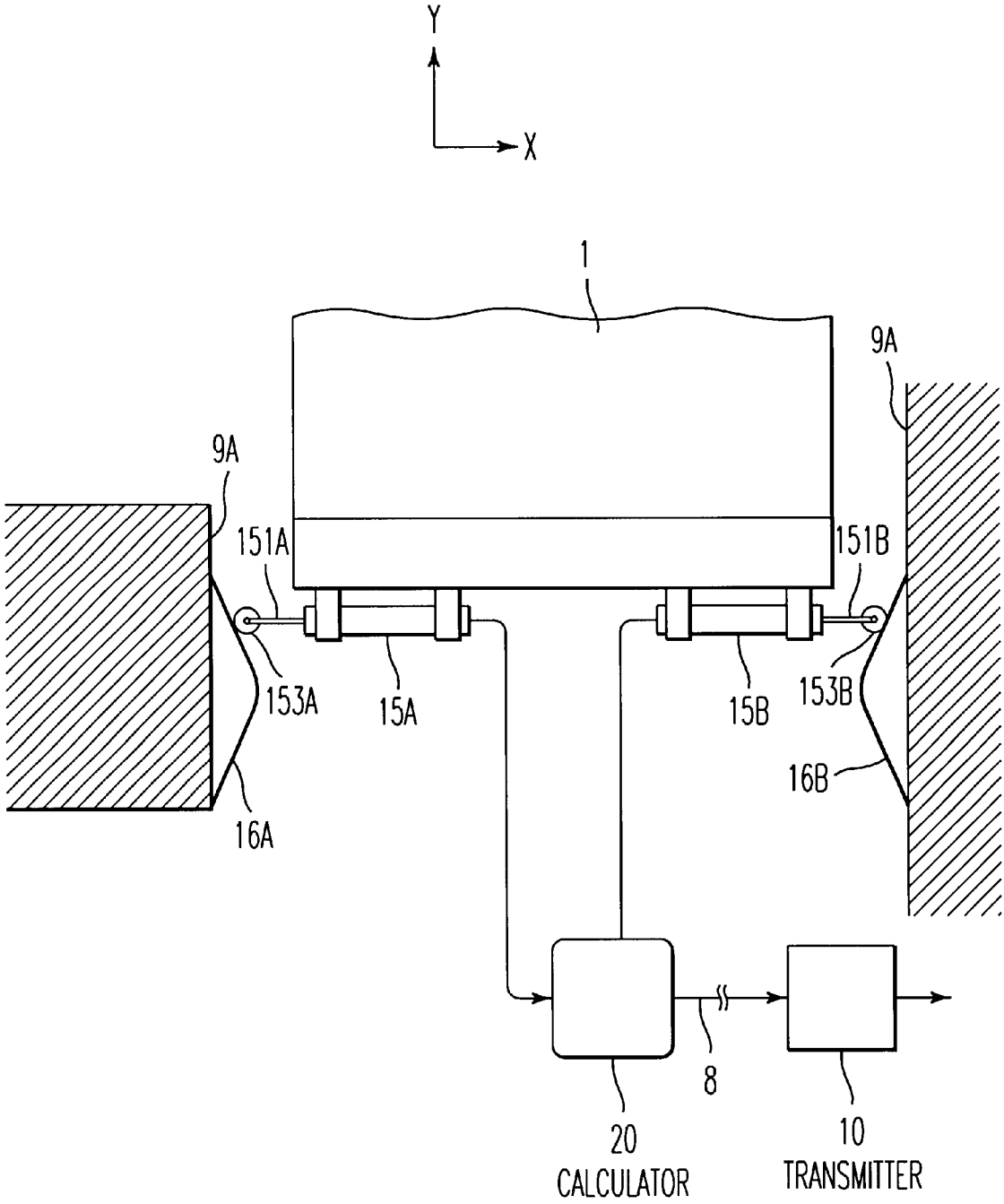
FIG. 8 is a side view of a load detector for an elevator of a fifth embodiment of the present invention.

FIG. 8 shows a load detector for an elevator cage of the fifth embodiment of the present invention, in which the load detector has two position sensors such as the potential meter 15 in FIG. 5, attached to the bottom of the cage 1, so as to correct an error caused by an inclination of the cage 1 and to calculate a load of the cage 1 precisely.

That is, two potential meters 15A and 15B are attached to the bottom edges of the cage 1 symmetrically.

Rollers 153A and 153B are respectively arranged to face toward the shaft wall 9*a*, and slide shafts 151A and 151B are respectively arranged to the same horizontal plane. Further, slopes 16A and 16B are secured on the shaft wall 9*a* near all floor levels. Each slope 16 has the same inclined plane as the FIG. 5. Output signals of the potential meters 15A and 15B are transmitted to the transmitter 10 via a calculator 20.

Thus, the potential meters 15A and 15B respectively detect horizontal changes of the slide shafts 151A and 151B and respectively output voltage signals. The calculator 20 averages these voltage signals and transmits an averages signal to the transmitter 10.

According to the fifth embodiment, two potential meters 15A and 15B are attached to the bottom edges of the cage 1 symmetrically, and output signals of the potential meters 15A and 15B are averages. Therefore, even if the cage 1 inclines due to a biased load in the cage 1, a vertical position change of the cage 1 can be detected properly. As a result, the load detector can be precise.

In the fifth embodiment, two potential meters 15A and 15B are applied to the position sensor. Obviously, the optical position sensor 17 in FIG. 6 can be substituted for the potential meters 15A and 15B.

Figure 9:
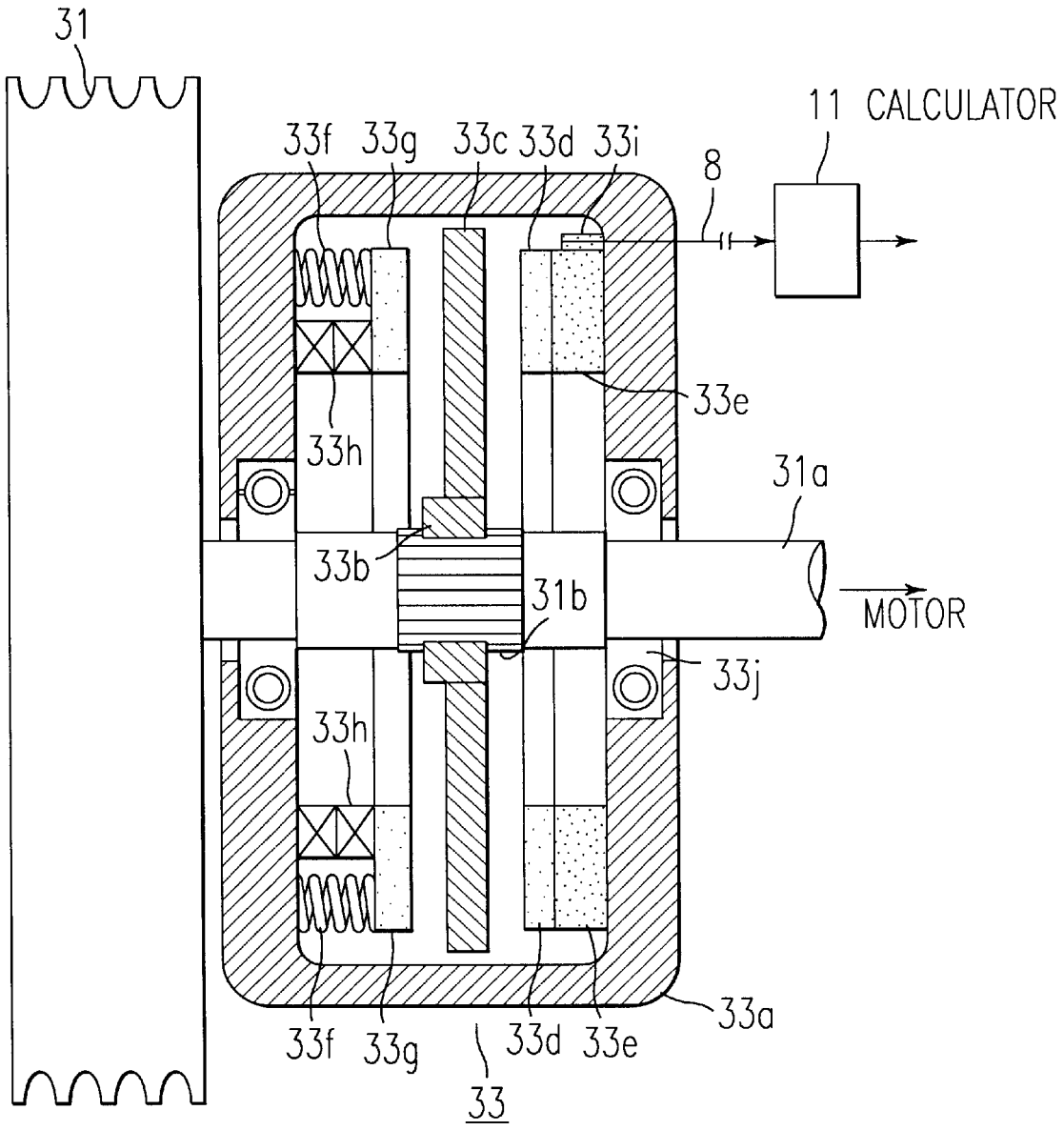
FIG. 9 is a sectional view of a brake showing a load detector for an elevator of a sixth embodiment of the present invention.
Figure 10:
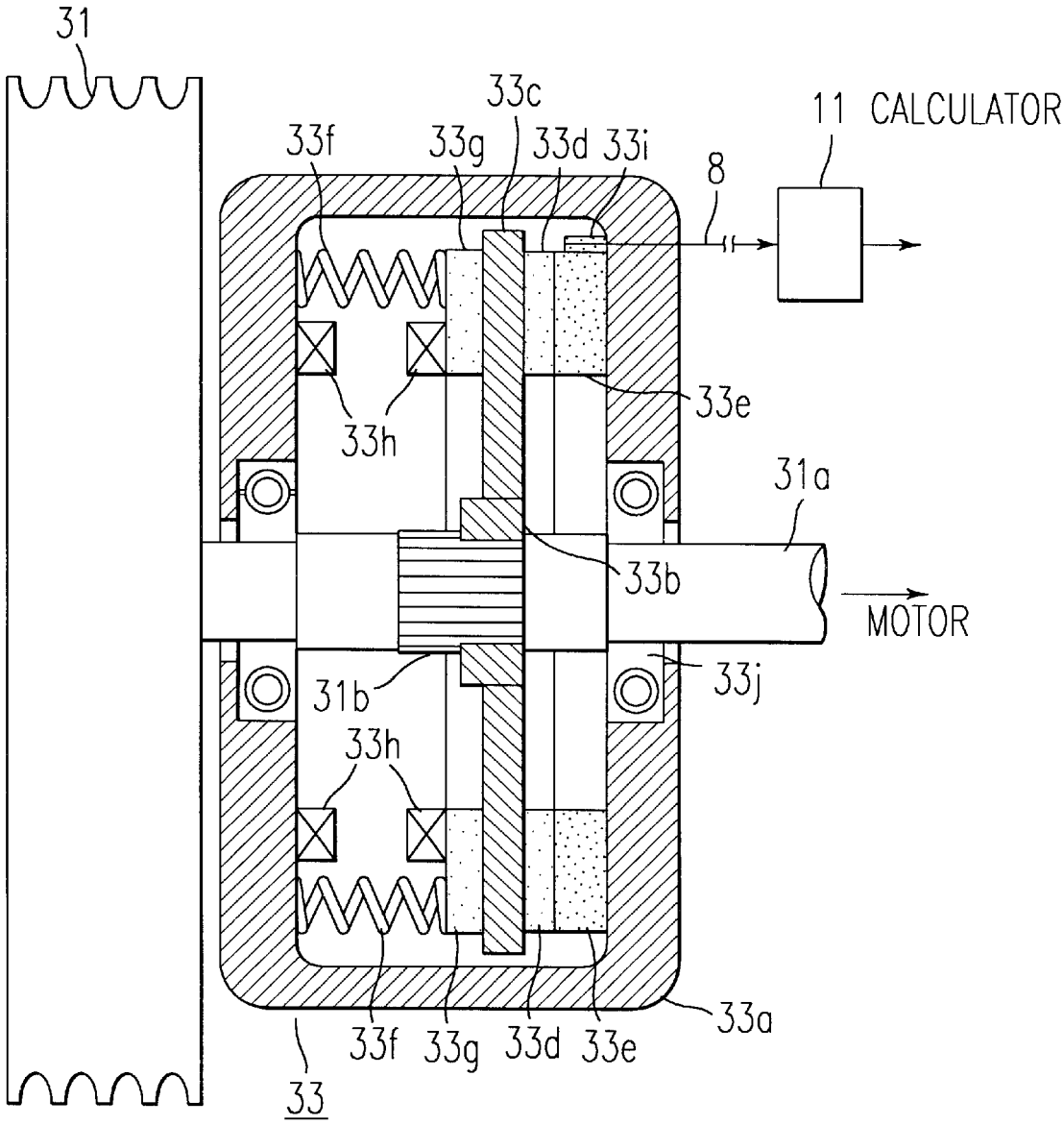
FIG. 10 is a sectional view of a brake showing a load detector for an elevator of a sixth embodiment of the present invention.

FIG. 9 and FIG. 10 are sectional views of a brake showing a load detector for an elevator cage of the sixth embodiment of the present invention.

In the following description, only components different from the components explained in the related art in FIG. 1 are described.

In FIG. 9, a brake 33 is secured to a rotary shaft 31*a* between the sheave 31 and the motor 32 (not shown in FIG. 9). A sheave gear 31*b* having teeth on the surface is secured to the rotary shaft 31*a* in a housing 33*a* of the brake 33. A disk gear 33*b* meshes with the sheave gear 31*b* slidably in an axis direction. A brake disk 33*c* is secured to the surface of the disk gear 33*b*. Further, a ring-shaped brake shoe 33*d* is attached to an inside wall of the housing 33*a* of the brake 33. A ring-shaped elastic ring 33*e* lies between the brake shoe 33*d* and the inside wall of the housing 33*a*. A brake shoe 33*g* is attached to the other inside wall of the housing 33*a* via springs 33*f*. Electromagnets 33*h* are arranged between the brake shoe 33*g* and the inside wall of the housing 33*a*. Furthermore, a strain gage 33*i* is attached on the surface of the elastic ring 33*e*. Bearings 33*j* are secured between the housing 33*a* and the rotary shaft 31*a*. An output signal of the strain gage 33*i* is transmitted to the calculator 11.

The operation of the above composed brake 33 is described as follows.

At the time a proper current is applied to electromagnets 33*h*, the springs 33*f* are contracted by an attraction force of the electromagnets 33*h*, and the brake shoe 33*g* shifts away from the brake disk 33*c* as shown in FIG. 9. Eventually, the brake disk 33*c* rotates freely between the brake shoes 33*g* and 33*d*, and the sheave 31 is driven by the motor 32 without brake resistance.

On the contrary, at the time a current is not applied to electromagnets 33*h*, the springs 33*f* expands and pushes the brake shoe 33*g* toward the brake disk 33*c* as shown in FIG. 10. Eventually, the brake disk 33*c* is caught between the brake shoes 33*g* and 33*d*, and the sheave 31 is locked.

A load of the cage 1 is applied to the rotary shaft 31*a* via the sheave 31. If a weight unbalance between the cage 1 and the counter weight 5 occurs due to a load change of the cage 1, a torsion force is applied to the sheave 31 corresponding to the weight imbalance, and the surface of the elastic ring 33*e* is pushed by the brake disk 33*c* connected to the sheave 31. As a result, the strain gage 33*i* outputs a voltage signal corresponding to a torsion force applied to the elastic ring 33*e*. The voltage signal is transmitted to the calculator 11. The calculator 11 calculates a torsion torque change of the sheave 31 on the basis of the voltage signal from the strain gage 33*i*, and calculates a load change of the cage 1 on the basis of the torsion torque.

According to the sixth embodiment, a load change of the cage 1 is calculated by calculating a torsion torque change of the sheave 31 locked by the brake 33. As a result, a load of the cage 1 can be obtained on the basis of a load change of the cage 1.

Figure 11:
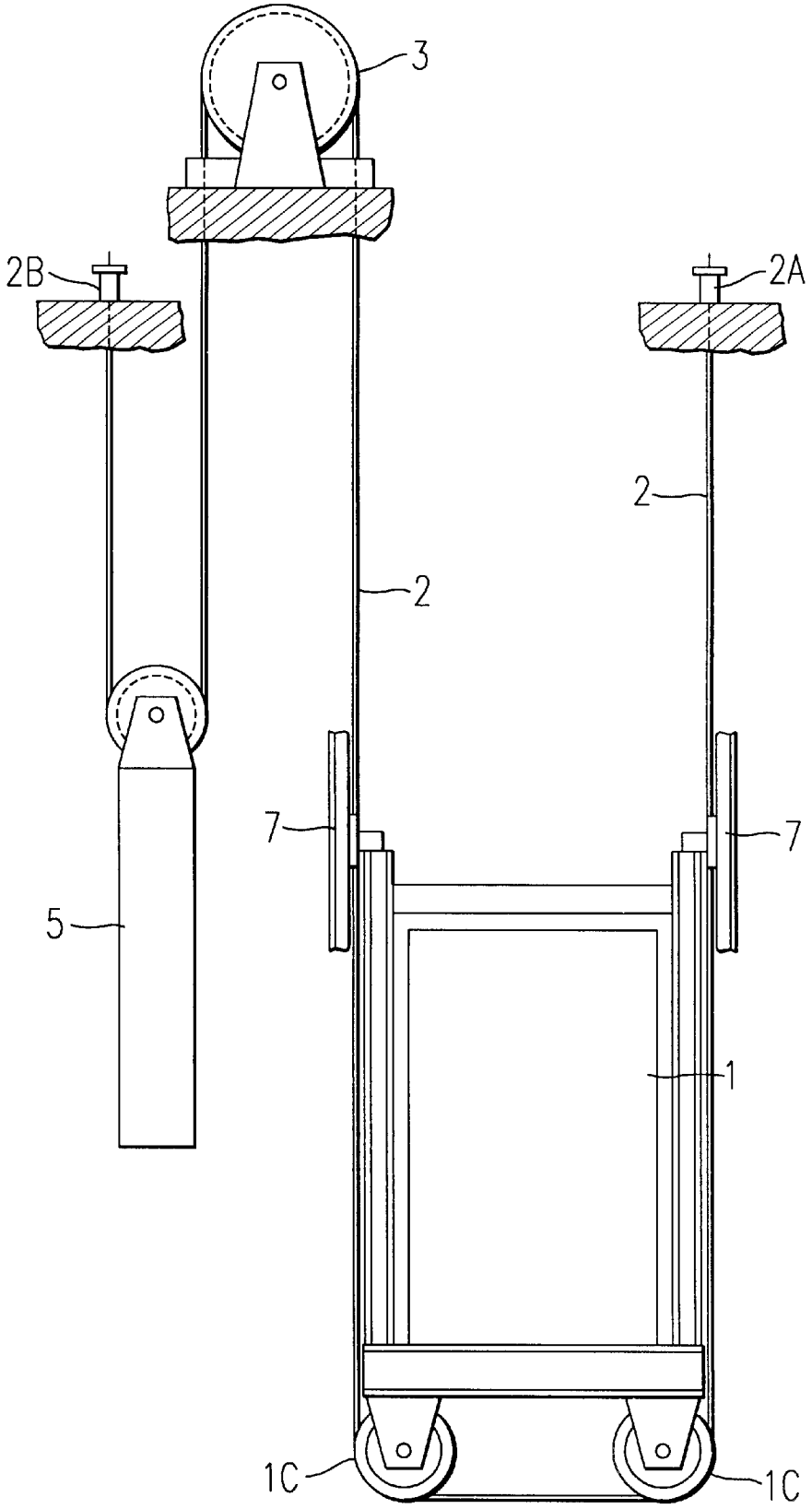
FIG. 11 is a schematic illustration of an elevator having hanging sheaves.

FIG. 11 is a side view of a traction type elevator having hanging sheaves.

In the following description, only components different from the components explained in the related art in FIG. 1 are described.

In this type of elevator, the cage 1 has a "single" construction, that is to say, the cab is integrated with the cage frame. One end of the cable 2 is secured to a hitch 2B at an upper portion of the shaft 9. The other end of the cable 2 is secured to a hitch 2A via the counter weight 5, the hoisting machine 3, and hanging sheaves 1C of the cage 1. The cable 2 is driven by the hoisting machine 3, and the cage 1 and the counter weight 5 relatively move up and down.

Figure 12:
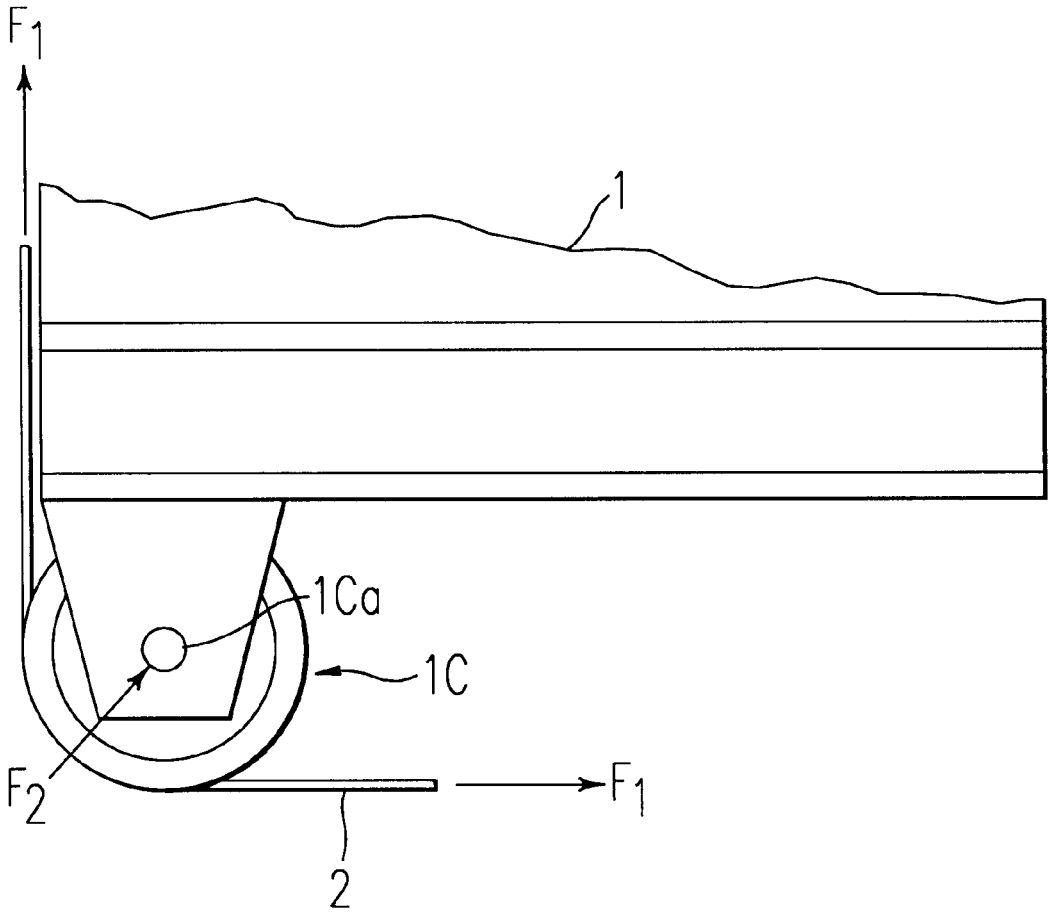
FIG. 12 is a partial view of hanging sheaves shown in FIG. 11.

In the above composed elevator, as shown in FIG. 12, a tension F1 corresponding to a load of the cage 1 is applied to a shaft 1C*a* of the hanging sheave 1C. A change of the tension F1 corresponds to a load change of the cage 1. Consequently, a change of a force F2 applied to the shaft 1C*a* corresponds to a load change of the cage 1.

Figure 13:
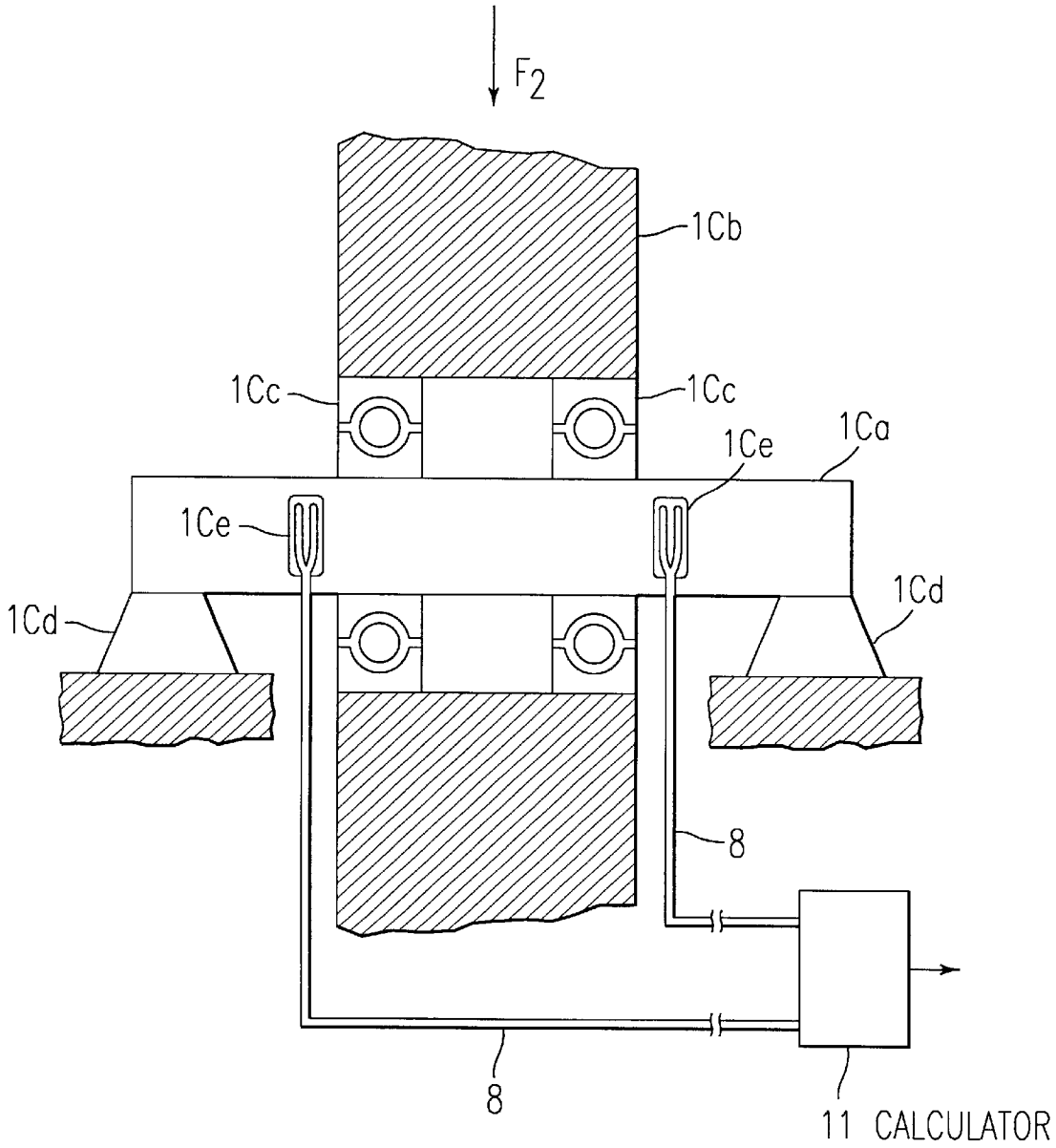
FIG. 13 is a sectional view of a hanging sheave showing a load detector for an elevator of a seventh embodiment of the present invention.

FIG. 13 is a sectional view of a hanging sheave showing a load detector for an elevator cage of a seventh embodiment of the present invention, in which the load detector detects a change of the force F2 applied to the shaft 1C*a* by means of a strain gage.

That is, as shown in FIG. 13, the shaft 1C*a* (only one is shown) is rotatably secured to the cage 1 via a bearing 1C*c*, and the shaft 1C*a* is supported by support members 1C*d* on the cage 1. Strain gages 1C*e* are built in the shaft 1C*a* near the bearing 1C*c* so as to detect a strain caused by a force F2 applied to the rotary shaft via the bearing 1C*c*. Output signals of the strain gages 1C*e* are transmitted to the calculator 11 via the transmitting cable 8 shown in FIG. 1. The calculator 11 calculates a load change of the cage 1 on the basis of the detected strain. Finally, the calculator 11 calculates a necessary torque to drive the motor 32 so as to start the cage 1 smoothly on the basis of the load of the cage 1.

Figure 14:
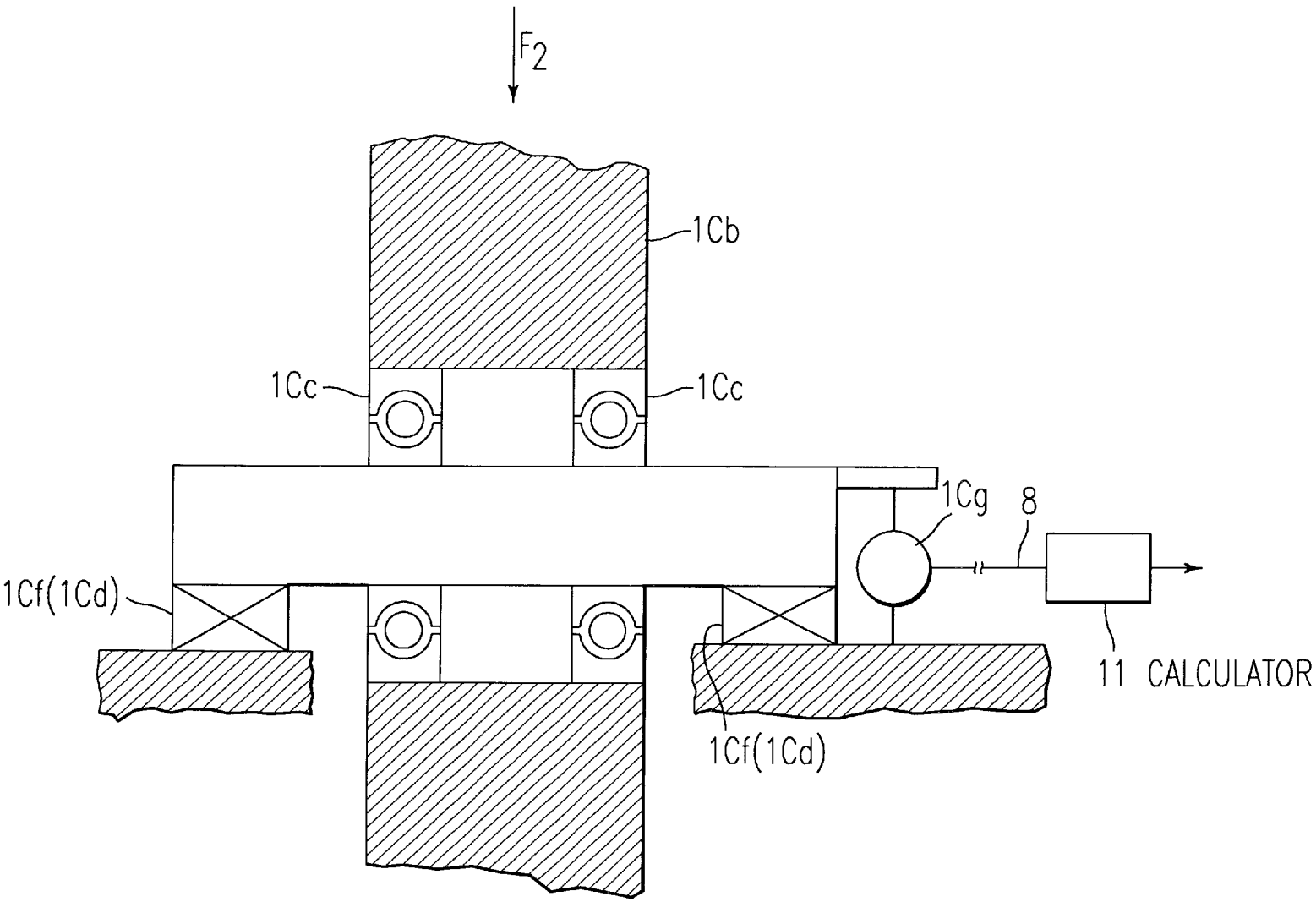
FIG. 14 is a sectional view of a hanging sheave showing a load detector for an elevator of an eighth embodiment of the present invention.

FIG. 14 is a sectional view of a rotary shaft showing a load detector for an elevator cage of an eighth embodiment of the present invention.

In FIG. 13, a load of the cage 1 is calculated on the basis of a force F2 applied to the shaft 1C*a* and detected by the strain gages 1C*e* built in the shaft 1C*a*, while in FIG. 14, a load of the cage 1 is calculated on the basis of a strain of elastic members 1C*f* lying between the shaft 1C*a* and the cage 1 instead of the support members 1C*d* in FIG. 13.

That is, as shown in FIG. 14, a force F2 is applied to the cage 1 via the bearing 1C*c*, the shaft 1C*a* and the elastic members 1C*f*. The elastic members 1C*f* deforms by a load change of the cage 1. The deformation of the elastic members 1C*f* is detected by a potential meter 1C*g*, i.e., a differential transformer which transforms displacement into electric resistance, attached in parallel to one of the elastic members 1C*f*. An output signal of the potential meter 1C*g* is transmitted to the calculator 11 via the transmitting cable 8. The calculator 11 calculates a load change of the cage 1 on the basis of the detected deformation. Finally, the calculator 11 calculates a necessary torque to drive the motor 32 so as to start the cage 1 smoothly on the basis of the load of the cage 1.

According to the eighth embodiment, since a load detector is installed at the hanging sheave 1C, a load of the cage 1 is detected precisely.

Figure 15:
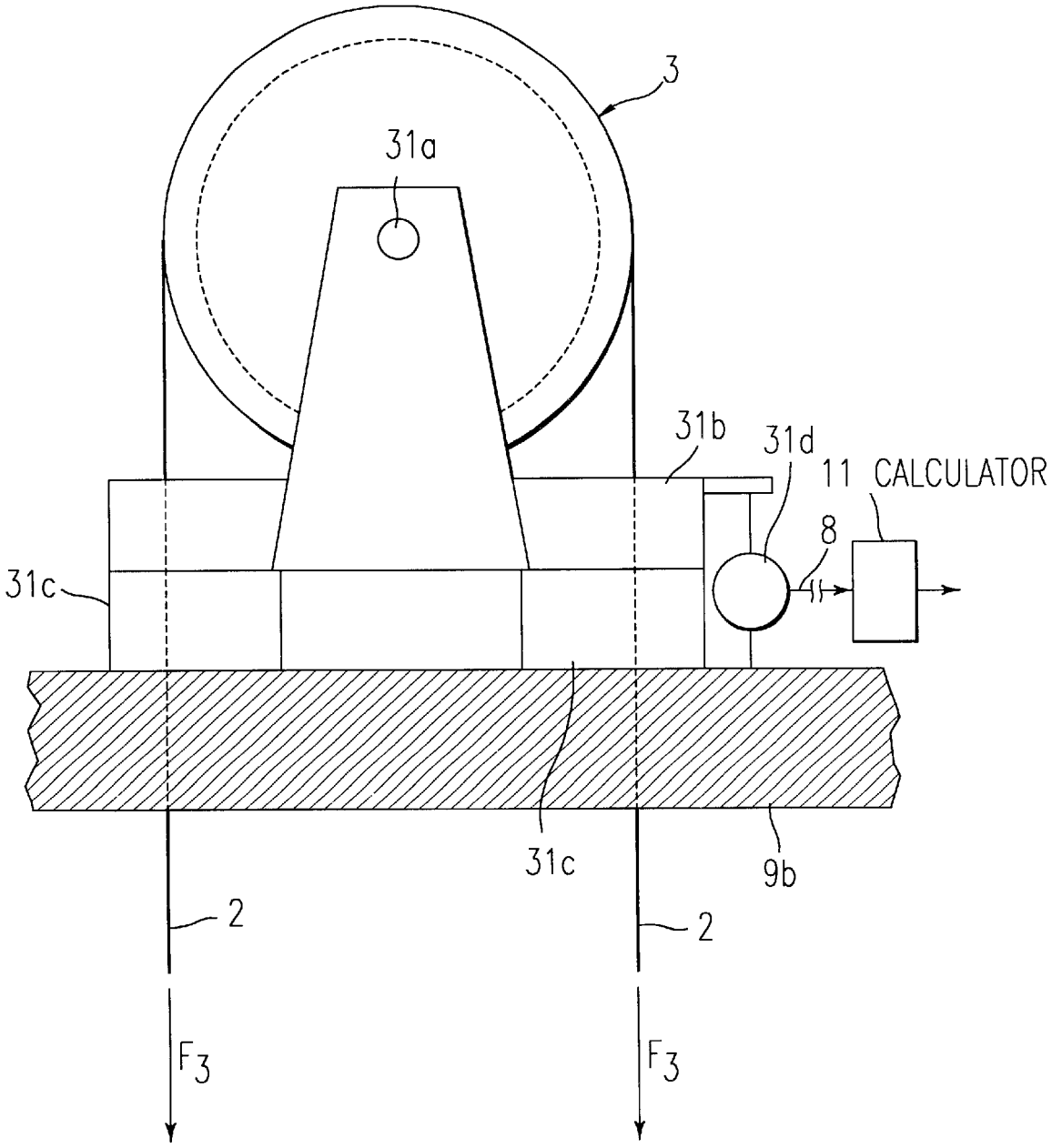
FIG. 15 is a side view of a sheave showing a load detector for an elevator of a ninth embodiment of the present invention.

FIG. 15 is a side view of a sheave showing a load detector for an elevator cage of a ninth embodiment of the present invention.

In FIG. 15, the hoisting machine 3 is arranged on a shaft ceiling wall 9*b* via two elastic members 31*c*. A potential meter 31*d* is attached in parallel to one of the elastic members 31*c*. The potential meter 31*d* outputs a voltage signal corresponding to a deformation of the elastic member 31*c*. An output signal of the potential meter 31*d* is transmitted to the calculator 11 via the transmitting cable 8.

A force F3 applied to the rotary shaft 31*a* of the sheave 31 is based on the sum of a load of the cage 1, a load of the counter weight, a load of the cable 2 and a load of the hoisting machine 3. Above all, the load of the cage 1 is the only item to be changeable.

Thus, a load of the cage 1 is calculated on the basis of a deformation of the elastic member 31*c* detected by the potential meter 31*d*. Finally, the calculator 11 calculates a necessary torque to drive the motor 32 so as to start the cage 1 smoothly on the basis of the load of the cage 1.

Various modifications and variations are possible in light of the above teachings. Therefore, within the scope of the appended claims, the present invention may be practiced otherwise than as specifically described herein.

What is claimed as new and desired to be secured by Letters Patent of the United States is:

1. A load detector for an elevator having a cable placed around a sheave driven by a motor, said cable hanging a weight and a cage moving up and down in a shaft for transporting passengers, comprising:

a brake having a housing, a brake disk secured to a rotary shaft of said motor, and a brake shoe for pressing said brake disk toward an elastic ring disposed between said brake shoe and the inside wall of said housing and stopping the revolution of said sheave;

a strain detector attached to said elastic ring and configured to detect a torsional strain of said brake disk caused by an unbalance in weight between said cage and said weight; and a calculator configured to calculate a change of said torsional strain between a torsional strain just after said cage lands at a floor and a torsional strain just before said cage leaves said floor, and a load of said cage on the basis of said change of said torsional strain.

2. A load detector for an elevator having a cable placed around a sheave driven by a motor, said cable hanging a cage through a hanging sheave attached to said cage moving up and down in a shaft for transporting passengers, comprising:

a strain detector configured to detect a strain of a rotary shaft of said sheave caused by a bending force (F2) applied perpendicular to and intersecting the axis of said rotary shaft; and a calculator configured to calculate a load of said cage on the basis of said strain.

3. A load detector for an elevator having a cable placed around a sheave driven by a motor said cable hanging a cage through a hanging sheave attached to said cage moving up and down in a shaft for transporting passengers, comprising:

a strain detector configured to detect a strain of a shaft of said hanging sheave caused by a bending force (F2) applied perpendicular to and intersecting the axis of said rotary shaft; and a calculator configured to calculate a load of said cage on the basis of said strain.

* * * * *